US005897460A

United States Patent [19]

McBride et al.

[11] Patent Number: 5,897,460

[45] Date of Patent: *Apr. 27, 1999

[54] DUAL ACTION AIR RESISTANCE TREADMILL

[75] Inventors: Robert W. McBride, Springfield, Mo.; David Chen, Taichung, Taiwan; Michael R. Byrd, Springfield, Mo.

[73] Assignee: Stamina Products, Inc., Springfield, Mo.

[ * ] Notice: This patent is subject to a terminal disclaimer.

[21] Appl. No.: 08/900,571

[22] Filed: Jul. 25, 1997

Related U.S. Application Data

[63] Continuation-in-part of application No. 08/524,875, Sep. 7, 1995, Pat. No. 5,665,032.

[60] Provisional application No. 60/036,441, Jan. 29, 1997.

[51] Int. Cl.[6] ..... A63B 22/02

[52] U.S. Cl. ..... 482/54; 482/51

[58] Field of Search ..... 482/51, 54

[56] References Cited

U.S. PATENT DOCUMENTS 931,394 8/1909 Day ..... 482/54

5,665,032 9/1997 Chen ..... 482/54

5,674,156 10/1997 Watterson et al. ..... 482/54

*Primary Examiner*—Lynne A. Reichard

*Attorney, Agent, or Firm*—Cushman Darby & Cushman IP Group of Pillsbury Madison & Sutro LLP

[57] ABSTRACT

A motorless manually operated treadmill exerciser comprising a frame structure supporting a motorless manually operated treadmill assembly and a retardant assembly constructed and arranged to establish a retardant to the continued movement of the endless track of the treadmill assembly when the user desires to slow the walking or running speed or disembark. The retardant assembly comprising a motion transmitting mechanism operatively connected between the leading roller of the treadmill assembly and the fan rotor constructed and arranged to rotate the fan rotor in response to the rotation of the leading roller at an increased speed proportional to the speed at which the leading roller is rotated due to the forwardly facing user walking or running on the upper surface of the upper flight of said endless track, the arrangement being such as to enable the rotation of the fan rotor to create a flow of air entering through a lower air inlet to pass upwardly through openings in an upper guard to impinge on the forwardly facing user with a velocity which is determined by the rate at which the user is walking or running on the upper surface of the upper flight of the endless track.

14 Claims, 7 Drawing Sheets

DUAL ACTION AIR RESISTANCE TREADMILL

This application is based upon provisional application Ser No. 60/036,441 filed Jan. 29, 1997.

This application is a continuation-in-part of application Ser No. 08/524,875 filed Sep. 7, 1995 now U.S. Pat No. 5,665,032 in the name of David Chen for a Manual Treadmill Exerciser with Air Blowing Retardant Assembly.

This application relates to treadmill exercisers and more particularly to treadmill exercisers of the motorless manually operated type.

Motorless manually operated treadmill exercisers are advantageous when compared with motor operated treadmill exercisers in that they are less costly, and provide the user with a maximum exercise input for any given pace because all movements of the treadmill require the physical effort of the user whereas motorized treadmill exercisers require the user to simply keep pace with the treadmill as it is moved by the motor. A disadvantage of motorless treadmill exercisers as compared with motorized treadmill exercisers is that control of the retardation of the treadmill exerciser is not as simple as with motorized systems because of the tendency of the inertia of the treadmill to keep the treadmill in motion. This characteristic can have the tendency to impart an imbalance to the user which may result in a fall. Accordingly, there is a need to provide motorless manually operated treadmill exercisers with a retardant assembly which is more functionally desirable and more cost effective.

An object of the present invention is to fulfill the need set forth above. In accordance with the principles this objective is achieved by providing a copy of claim 1 suitable revised.

DETAILED DESCRIPTION OF THE PREFERRED EMBODIMENT

Figure 1:
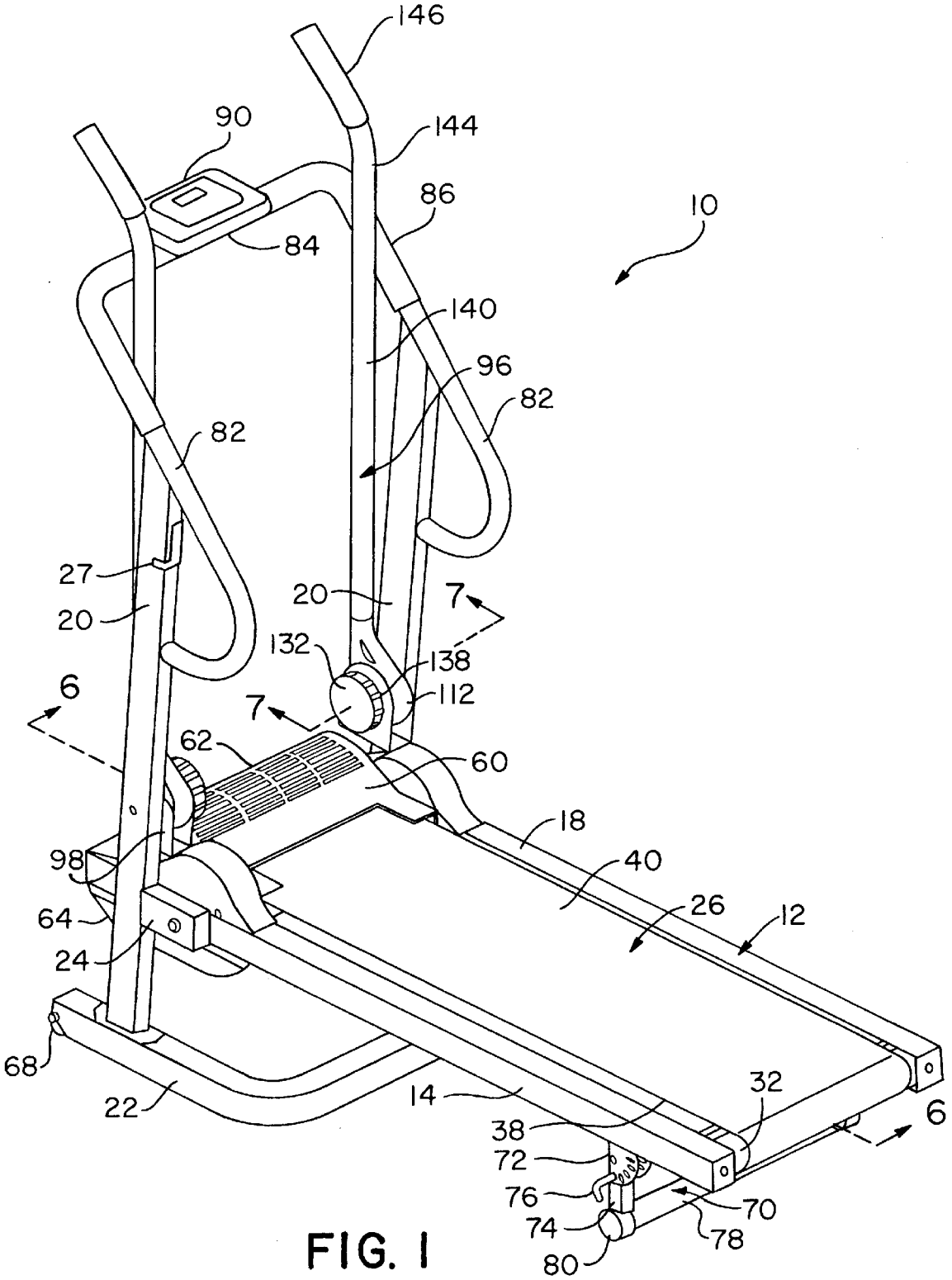
FIG. 1 is a perspective view of a dual action air resistance treadmill exerciser embodying the principles of the present invention as configured in the operating mode.

Referring to FIGS. 1 through 5, there is shown therein a dual action air resistance treadmill exerciser, generally indicated at 10, embodying the principles of the present invention. The exerciser 10 includes a frame structure, generally indicated at 12. The frame structure 12 is in the form of a three-sided rim including a pair of elongated transversely spaced parallel side frame members 14 and a connecting transverse member 16 configured in a generally right angled relationship to side frame members 14. Two side frame covering structures 18 are attached to the upper surface of the respective side frame members 14.

Figure 2:
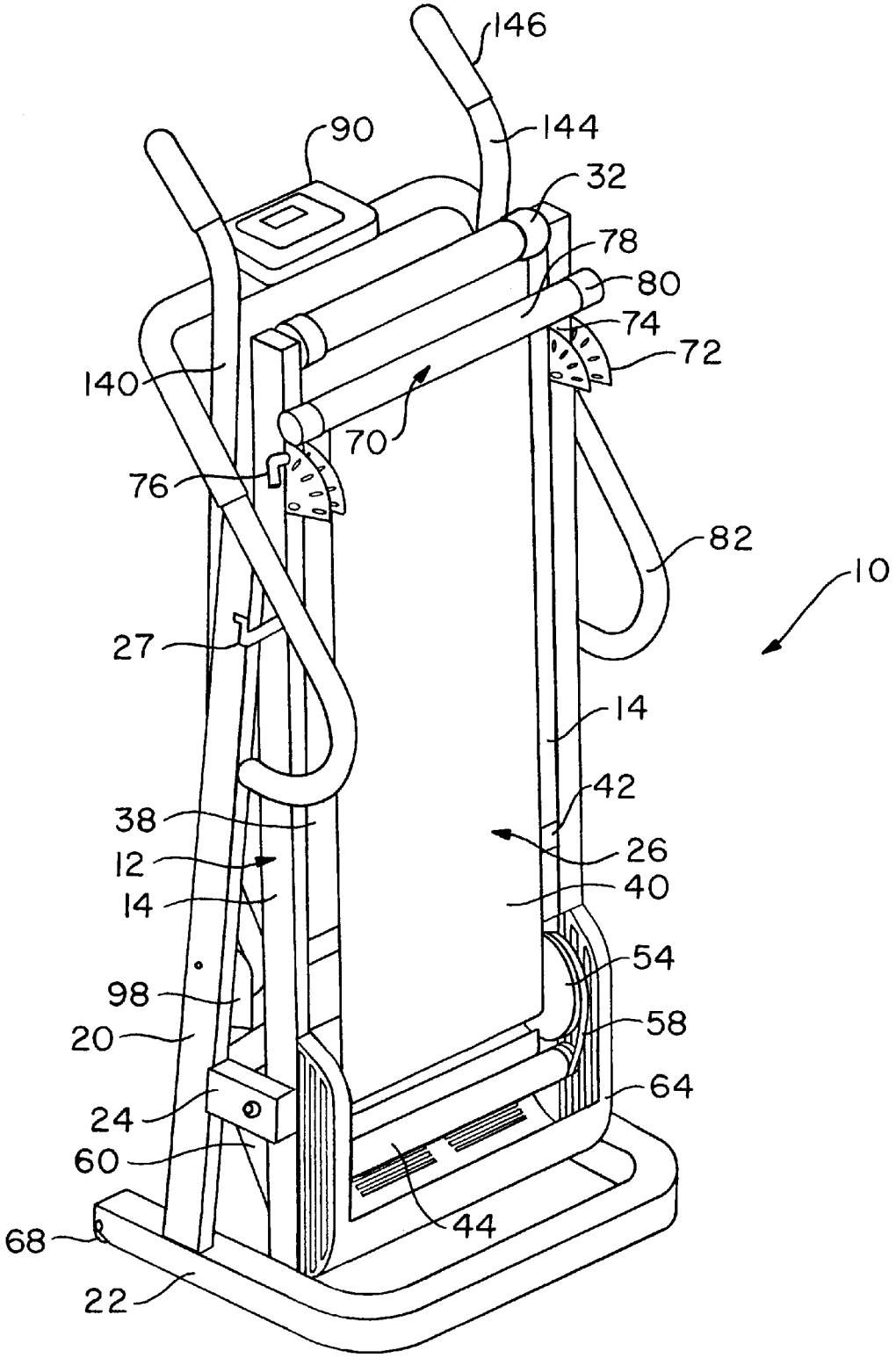
FIG. 2 is a perspective view of a dual action air resistance treadmill exerciser embodying the principles of the present invention as configured in the stored mode.
Figure 5:
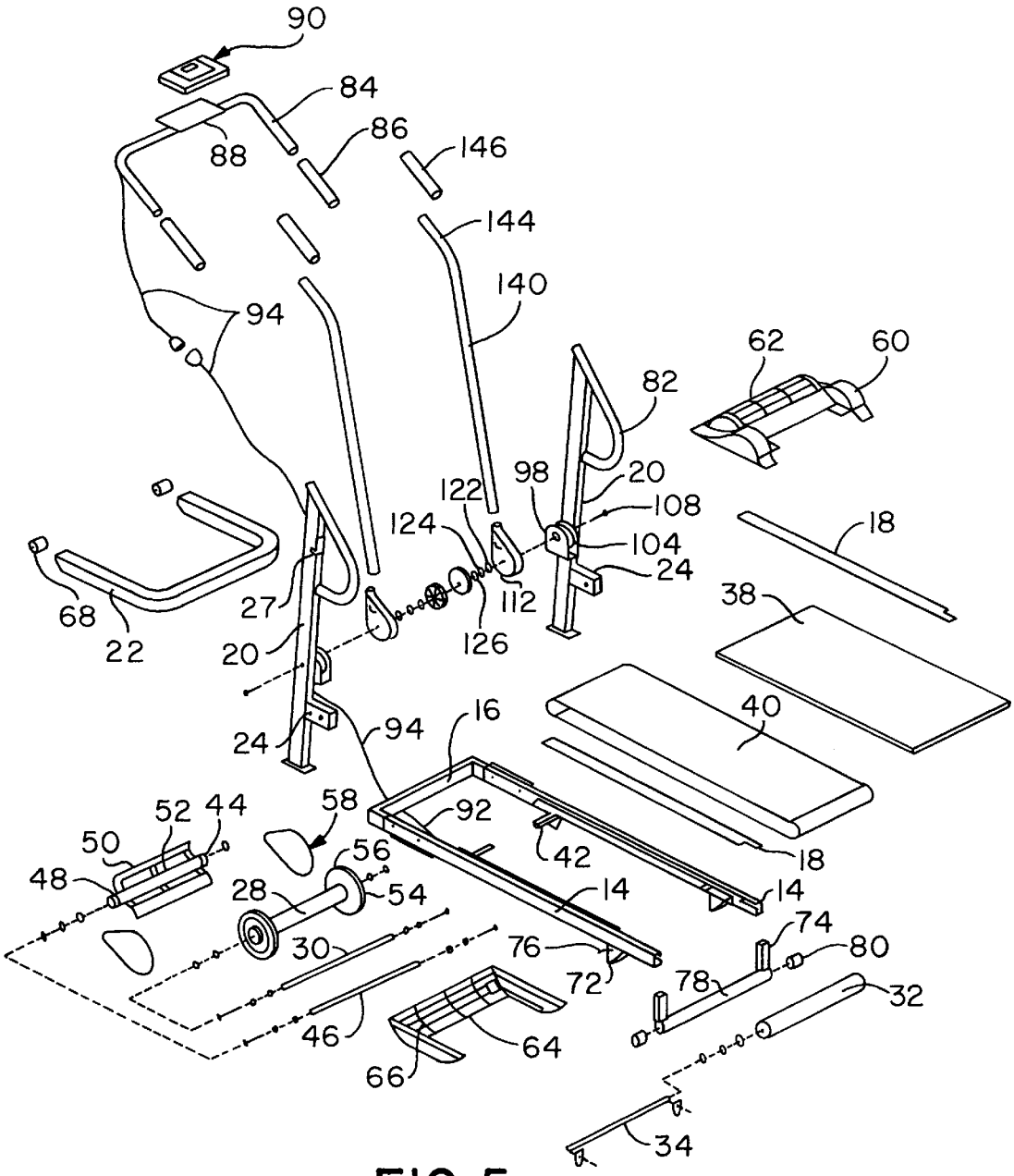
FIG. 5 is an exploded view of the dual action air resistance treadmill of FIG. 1.
Figure 6:
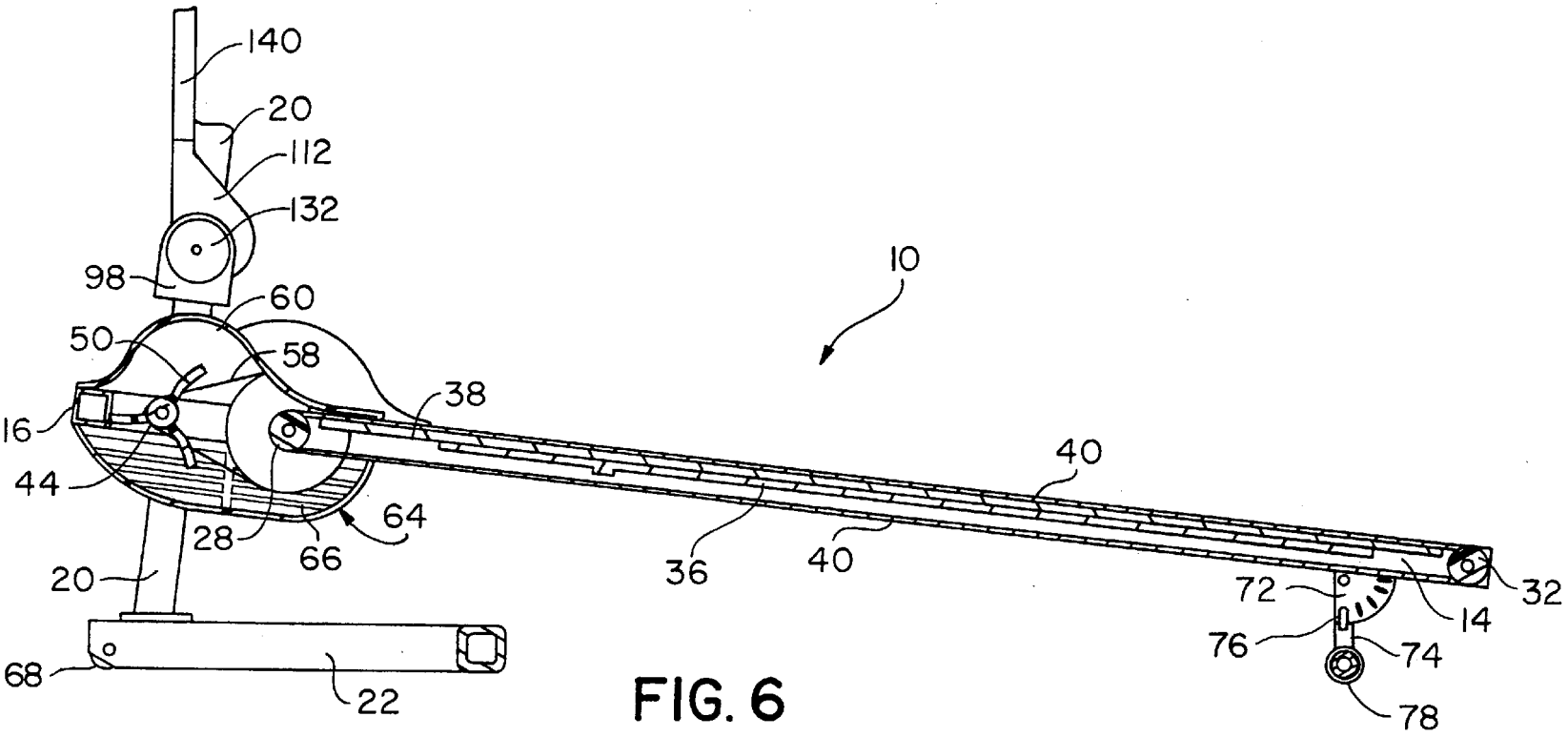
FIG. 6 is a sectional view taken along line 6—6 of FIG. 1.

Two transversely spaced upright support members 20 are attached and extend upwardly from a base structure 22 so as to form a base and upright support construction. Attachment members 24 extend from the lower portion of support members 20 in a generally parallel alignment with the side frame members 14 and are pivotally connected to side frame members 14. A treadmill assembly, generally indicated at 26, is supported between the side frame members 14. As shown in FIG. 2, pivotal attachment of side frame members 14 at the attachment members 24 permits vertical storage of the treadmill assembly when not in use. A locking member 27 is rotatably attached to at least one of the upright support members 20 for purpose of retaining the treadmill assembly 26 in a stored position when not in use. The treadmill assembly 26 includes a front or leading guide roller 28. The front guide roller 28 is rotatably mounted on a first axial retaining structure 30. The first axial retaining structure 30 is mounted transversely disposed proximate to the front end of the side frame members 14. A rear or trailing guide roller 32 is rotatably mounted on a second axial retaining structure 34. The second axial retaining structure 34 is mounted transversely disposed proximate to the rear end of the side frame members 14. FIGS. 5 and 6 show opposing track supporting structures 36 located between the front guide roller 28 and the rear guide roller 32. These track supporting structures 36 are connected to and extend transversely from the side frame members 14. A treadmill bridging structure 38 is connected to and forms a bridge between the opposing track supporting structures 36. A flexible endless track 40 is trained about the front guide roller 28 and the rear guide roller 32 so as to define a lower flight and an upper flight disposed in supported contact with the treadmill bridging structure 38. Two track centering guide members 42 are connected to and extend inwardly from the side frame members 14. Track centering guide members 42 make frictional contact with and maintain track 40 in a proximate centered orientation over the treadmill bridging structure 38 during operation.

FIGS. 5 and 6 show a shaft 44 which is rotatably mounted on a third axial retaining structure 46. The third axial retaining structure 46 is mounted transversely disposed between the side frame members 14 in forwardly spaced relation in front of the front guide roller 28. The shaft 44 has two belt mounting grooves 48 therein disposed around the periphery at opposite ends thereof. A series of annularly spaced fan blades 50 are fixed to the shaft 44 around the periphery between the belt mounting grooves 48 and form therewith a fan rotor. Each fan blade 50 has a plurality of openings 52 for reducing noises upon the rotation of the shaft 44. As shown in FIG. 5 of the drawings, the transverse extent of the series of fan blades 50 is substantially coextensive with the transverse extent of the endless track 40.

Two fly wheels 54 are fixedly mounted with respect to the front guide roller 28 at opposite ends thereof. Each fly wheel 54 has a belt mounting groove 56 around the periphery. Two transmission belts 58 are respectively mounted on the belt mounting grooves 48 of the shaft 44 and the belt mounting grooves 56 of the fly wheel 54. The belts 58 and the grooved members about which they are trained constitute a belt and pulley motion transmitting mechanism which serves to rotate the shaft 44 and series of fan blades 50 in response to the rotation of the front guide roller 28 at an increased speed which is proportional to the speed of the roller 28. When the track 40 is moved by a forwardly facing user walking or running on the upper surface of the upper flight of the track 40, the fly wheels 54 are turned to rotate the shaft 44 through the movement of the transmission belts 58. When the shaft 44 is rotated, the fan blades 50 are moved to cause a flow of air. Therefore, the shaft 44 and the fan blades 50 form a wind wheel, which creates a wind resistance tending to retard the movement of the track 40. When the treadmill assembly 26 is operated to move the track 40, the guide rollers 28 and 32 are rotated by the track 40, and therefore the inertia force from the track 40 and the rollers 28 and 32 is reduced by the wind resistance.

FIGS. 1–6 show an upper guard 60 mounted on the frame structure 12 between side frame members 14 at the front ends thereof and extends transversely over the shaft 44 and the blades 50. The upper guard 60 has a plurality of openings or vent holes 62 for directing air therethrough to impinge upon a forwardly facing user walking or running on the upper surface of the upper flight of the track 40. FIGS. 1, 2, 5, and 6 show a lower guard 64 positioned beneath the frame structure 12 between side frame members 14 in proximate alignment with the upper guard 60. The lower guard has a plurality of openings or vent holes 66 for permitting air flow access to the shaft 44 and the blades 50.

While the apertured guard 64 is shown as extending vertically on opposite sides of the fan rotor, it is within the contemplation of the present invention to have the apertured guard 64 extend below the fan rotor as well. So long as the arrangement is such that the fan rotor is disposed above the supporting surface sufficiently to provide an air inlet for the fan rotor either around the guard 64 and/or through the apertures of the guard.

FIGS. 1, 2, 4, 5 and 6 show a pair of rotational support members 68 attached to the base structure 22. Together the base structure 22 and the rotational support structures 68 provide foundational support under the section of the exerciser 10 housing the shaft 44 and the blades 50. The rotational support members 68 also serve to facilitate relocation of the exerciser 10 as needed. Foundational support for the end of the exerciser 10 opposite the base structure 22 is provided by the adjustable foundation assembly, shown generally as 70. An incline selector structure 72 depending from each of the side frame members 14 allows the selection of one of several incline positions of the exerciser 10 relative to the horizontal surface upon which the exerciser 10 is placed. A rotating vertical support structure 74 is pivotally connected at its upper section to the incline selector structure 72. The rotating vertical support structure 74 is rotated to a selected incline position and is retained in that position by repositioning the incline locking member 76. A vertical u-shaped support connecting member 78 connects the opposing rotating vertical support structures 74. The vertical support connecting member 78 provides additional foundational support and facilitates coordinated movement of the rotating vertical support structures 74 when the user selects an incline position. Protecting cap members 80 are secured at each end of the vertical support connecting member 78.

Figure 3:
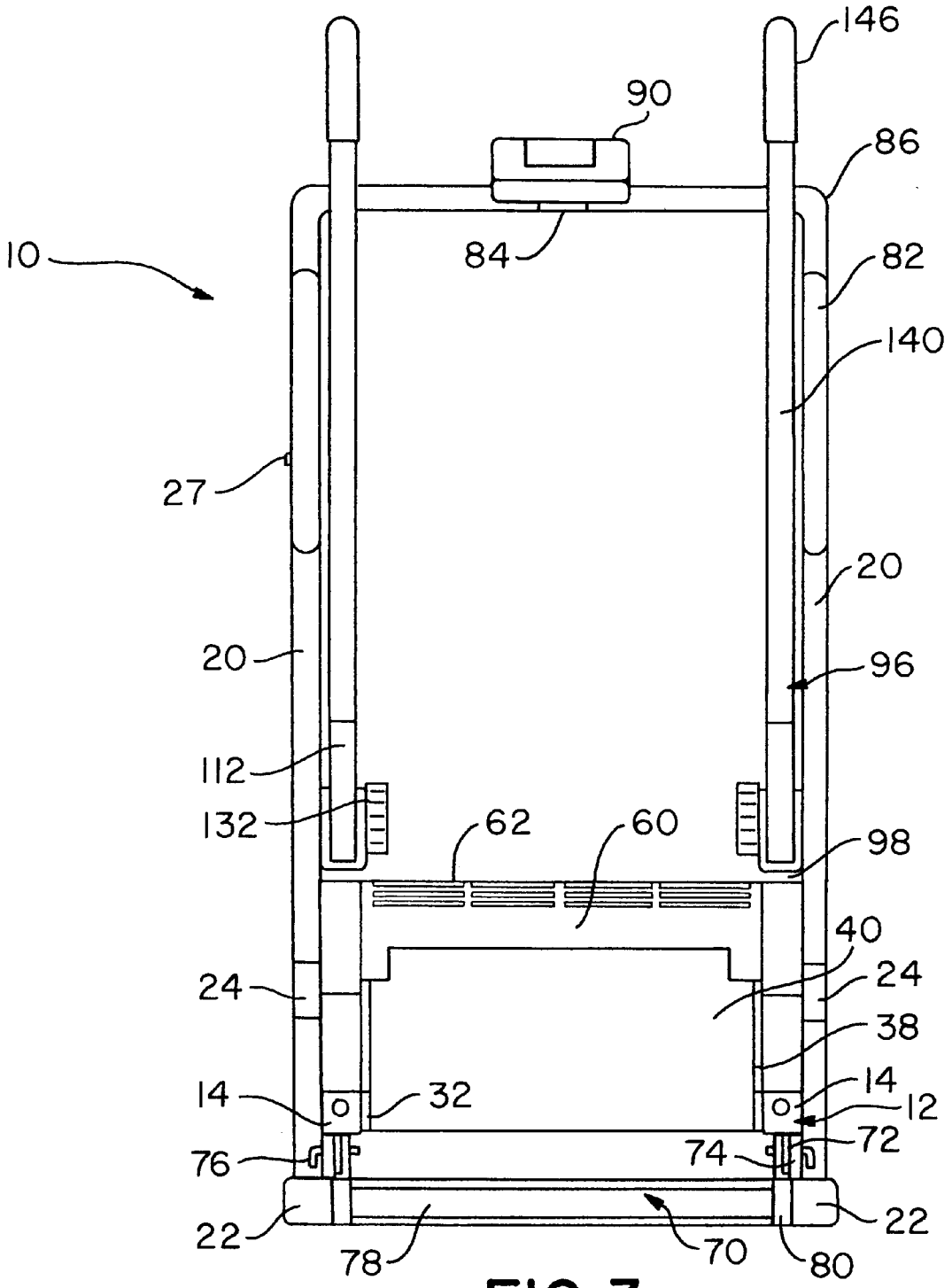
FIG. 3 is a front elevational view of a dual action air resistance treadmill embodying the principles of the present invention as configured in the operating mode.
Figure 4:
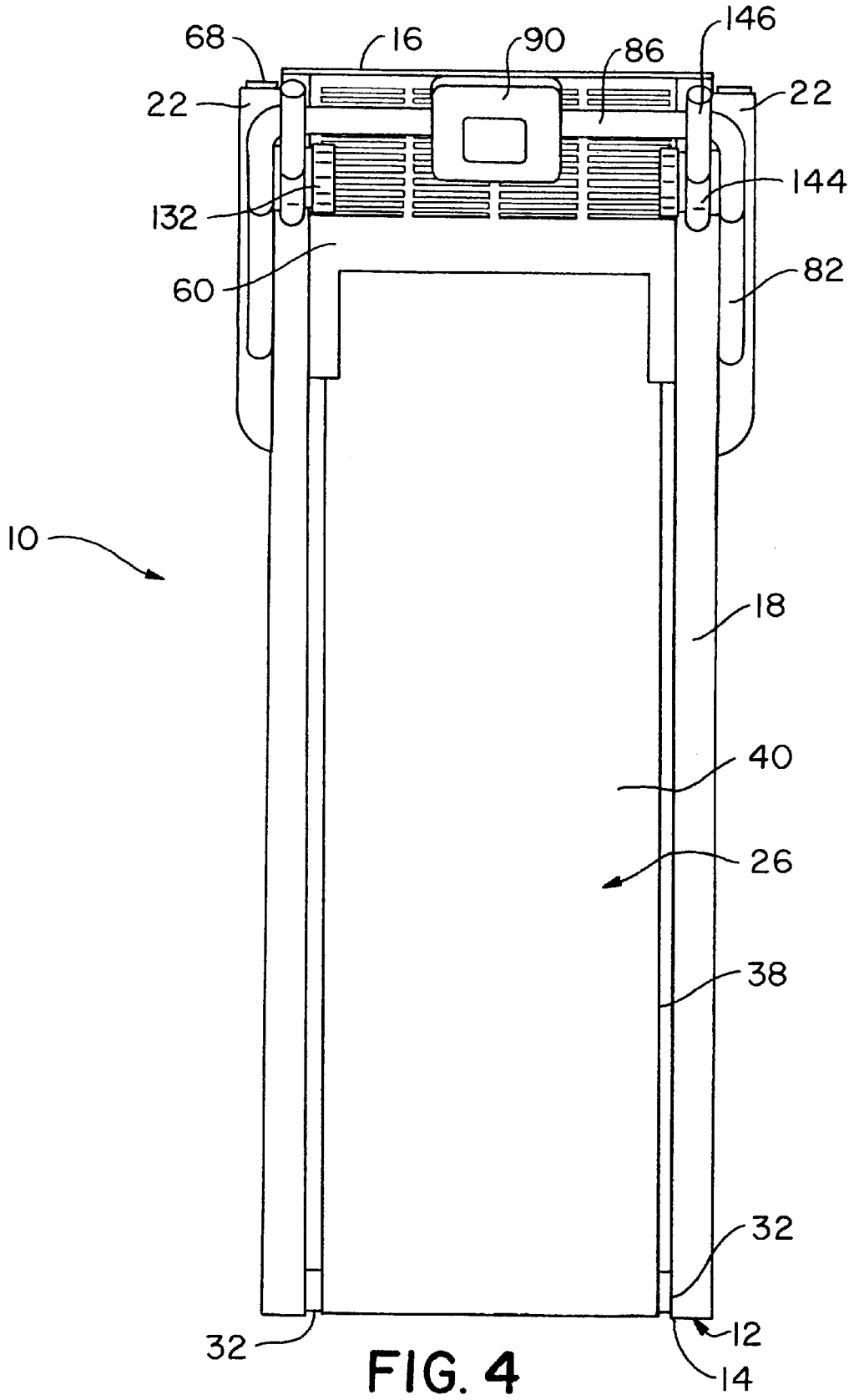
FIG. 4 is a top view of a dual action air resistance treadmill embodying the principles of the present invention as configured in the operating mode.

FIGS. 1–5 show an upright support grasping structure 82 connected to each of the upright support members 20. The two upright support grasping structures 82 provide the user with upper body stability when mounting, dismounting or using the exerciser 10. FIGS. 1, 3 and 5 show a grasping structure connecting member 84 which connects the opposing upright support grasping structures 82 providing a structural stability to the upright support members 20. A grasping structure protecting member 86 is provided over the grasping structure protecting member 82. FIGS. 3 and 5 show a display mounting member 88 positioned on the upper surface of the grasping structure connecting member 84 which serves as a mounting base for a data computing and display assembly 90. A sensor member 92 for the collection of treadmill operation data is attached to side frame member 14 and is positioned proximate to the treadmill assembly 26. FIG. 5 shows a signal transmission conduit 94 which conducts sensor signals from the sensor member 92 to the data computing and display assembly 90.

Figure 7:
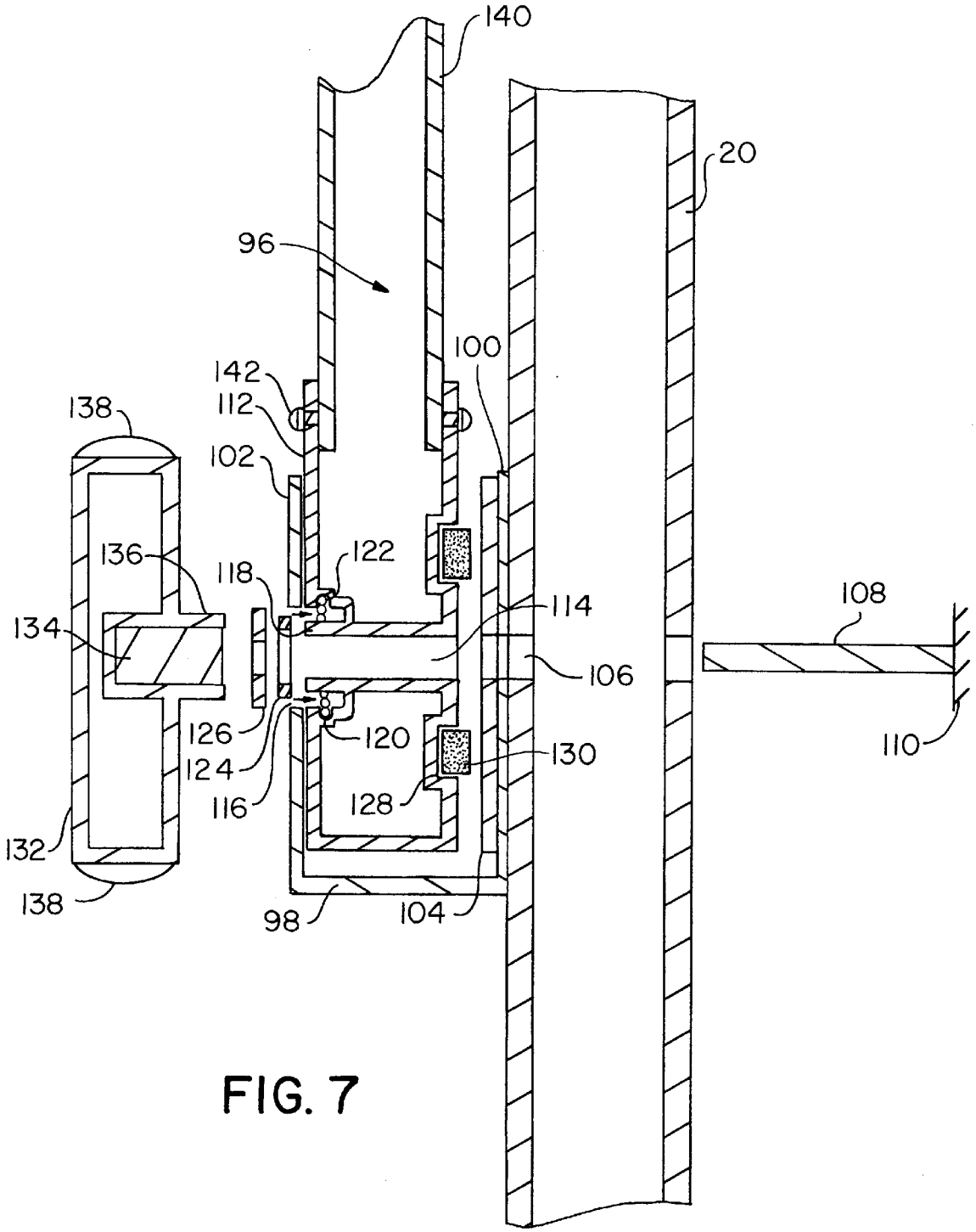
FIG. 7 is an enlarged sectional view taken along line 7—7 of FIG. 1 showing details of the lower portion of the rotatably mounted member of the dual action air resistance treadmill.

FIGS. 1, 3, 5 and 7 show another feature of the exerciser 10; an upper body exercising assembly, generally indicated at 96. As shown in FIG. 7 a retaining structure 98 is integral with and extends inwardly from the each of the upright support members 20. The retaining structure 98 has a first bracketing member 100 attached to the upright support member 20 and a second bracketing member 102 integral with and disposed parallel to the first bracketing member 100. As shown in FIG. 5 and 7, a friction plate structure 104 is connected to the inner surface of the first bracketing member 100 of the retaining structure 98. The purpose of the friction plate structure 104 is to operationally enhance friction between the upper body exercising assembly 96 and the retaining structure 98. The upright support structure 20 together with the first and second bracketing members 100 102 of the retaining structure 98 and the friction plate structure 104 define an axially aligned stationary assembly bore 106. An axial retaining member 108 is terminated at one end by a stop member 110 which limits the passage of the retaining member 108 through the stationary member bore 106. The second end of the retaining member 108 is threaded and is sized to pass relatively unimpeded through the stationary assembly bore 106. Each of the upper body exercising assemblies 96 are individually connected to the respective upright support member 20 through rotational attachment to the respective retaining structure 98. Rotational connection of the upper body exercising assemblies 96 is made through a rotating hub member 112 which is sized and shaped to freely rotate when engaged between the first and second bracketing members 100 102 of the retaining structure 98. The rotating hub member 112 defines a first end of a rotating assembly bore 114 The rotating assembly bore 114 is sized to allow the rotating hub member 112 to freely rotation about the retaining member 108. As shown in FIG. 5, the inner surface of the rotating hub member 112 defines an inner surface recess 116 which extends from a larger diameter first portion toward the rotating assembly bore 114. The inner surface recess 116 is limited by a skirting member 118 which also serves to define the middle portion of the rotating assembly bore 114. Within the first portion of the inner surface recess 116, an annular recess 120 is defined. A friction reduction member 122 is positioned within the annular recess 120. The friction reduction member 122 is retained in the annular recess 120 by a circular retaining member 124. A spacing member 126 is sized and shaped to securely retain the circular retaining member 124 in the rotating hub member 112. The spacing member 126 also serves as a covering surface over the inner surface recess 116. The spacing member 126 defines a bore which is sized to permit relatively unimpeded passage of the threaded end of the retaining member 108 and is aligned with and serves as a second end of the rotating assembly bore 114. The rotating assembly bore 114 is therefore defined sequentially by the rotating member 112, the integral skirting member 118 and the spacing member 126. Also shown in FIG. 7, the outer surface of the rotating hub member 112 defines a plurality of friction enhancer recesses 128. A friction enhancing member 130 is secured in each of the friction enhancer recesses 128. A portion of each of the friction enhancing members 130 protrudes beyond the outer surface of the rotating hub member 112. As shown in FIG. 7 in operable relationship the rotating hub member 112 is positioned within and in alignment with the retaining structure 98. The friction enhancing members 130 are outwardly protruding from the friction enhancer recesses 128 and are directly opposed to the friction plate structure 104.

When the upper body exercising assembly 96 is fully assembled, the threaded end of the retaining member 108 is passed unimpeded through the stationary assembly bore 106. The stationary assembly bore 106 is defined sequentially by four structures: the upright support member 20, the first bracketing member 100 of the retaining structure 98, the friction plate structure 104 and finally, after passage through the rotating assembly bore 114, the second bracketing member 102 of the retaining structure 98. As the threaded end of the retaining member 108 passes through the rotating assembly bore 114 it sequentially passes through three structures: the rotating hub member 112, the integral skirting member 118 and the spacing member 126. The threaded end of the retaining member 108 after passing through the stationary assembly bore 106 and the rotating assembly bore 106, passes through and protrudes from the second bracketing member 102. The protruding threaded end of the retaining member 108 is removably attached to a friction adjusting member 132. The friction adjusting member 132 defines a blind hole 134 sized and threaded to receive the threaded end of the retaining member 108. A skirting structure 136 depends from the central portion of the friction adjusting member 132 and defines a portion of the blind hole 134. Grip enhancing structures 138 are disposed on the surface of the friction adjusting member 132 to facilitate manual joining of the friction adjusting member 132 to the retaining member 108. In operation as the friction adjusting member 132 is engaged with the threaded end of the retaining member 108 the rotating hub member 112 is positioned toward the friction plate structure 104. The protruding friction enhancing members 130 are brought into increasing frictional contact with the friction plate structure 104 in proportion to the degree that the friction adjusting member 132 is tightened on to the retaining member 108. An elongated arm member 140 is attached at the lower end to the rotating hub member 112 by arm retaining connectors 142. An elongated arm member grasping structure 144 is provided at the upper end of the elongated arm member 140. The elongated arm member grasping structure 144 is protected by a grasping structure covering member 146.

Referring to FIGS. 1 and 3–6, when in operation the user steps on the treadmill assembly 26 facing forward with the hands rested on the upright support grasping structures 82. As shown, the upper flight of the track 40 slopes in an upwardly and forwardly direction facilitating the movement of the track 40 when the user walks or runs on it. When the track 40 is moved, the rollers 28 and 32 are rotated, and at the same time the fly wheels 54 are turned to rotate the shaft 44 through the transmission belts 58, causing the series of fan blades 50 to create a flow of air from the area beneath the series of fan blades 50 and outwardly through the openings or vent holes 62 of the upper guard 60 to impinge upon the user. In this way the shaft 44 and series of fan blades 50 constitute a retarding assembly operable to produce a wind resistance which serves to retard the movement of the track 40 when the user desires to slow the pace or disembark. The user can select the degree of incline of the track 40 using the adjustable foundation assembly 70 thereby altering the degree of difficulty and exercise benefit of the exerciser 10. To obtain the full benefit of the exerciser 10, the user may elect to use the upper body exercising assembly 96 while walking or running on the track 40. The user grasps and moves each of the elongated arm member grasping structures 144 in a reciprocating motion with enough force to overcome the frictional contact between the friction enhancing members 130 and the friction plate structure 104. This reciprocating motion causes the upper body exercising assembly 96 to rotate forward and back about the retaining structure 98. As shown in FIG. 2 the user, upon completion of an exercise period, can pivot the treadmill assembly 26 about the attachment member 24 to place the exerciser 10 into a storage position. The storage locking member 27 can be engaged to retain the treadmill assembly 26 in the storage position.

What is claimed is:

1. A motorless manually operated treadmill exerciser comprising a frame structure constructed and arranged to be mounted in an operative position on a solid horizontal support surface, said frame structure including a pair of elongated transversely spaced generally parallel frame members positioned to support a treadmill assembly above the horizontal support surface when said frame structure is in said operative position, said treadmill assembly including a trailing roller mounted between trailing ends of said spaced frame members for rotation about a transversely extending trailing roller axis, a leading roller mounted between forward end portions of said spaced frame members for rotation about a leading roller axis parallel to said trailing roller axis, a flexible endless track trained about said leading and trailing rollers so as to define an upper flight and a lower flight, and support structure extending between said pair of frame members between said leading and trailing rollers and between the upper and lower flights of said endless track, said support structure being constructed and arranged to support the movement of the upper flight of said endless track in response to a forwardly facing user manually walking or running on an upper surface of the upper flight of the endless track, and a retardant assembly constructed and arranged to establish a retardant to the continued movement of the endless track when the user desires to slow the walking or running speed or disembark, said retardant assembly comprising a fan rotor mounted between the forward end portions of said spaced frame members in forwardly spaced relation to said leading roller for rotation about an axis parallel with the leading roller axis, said fan rotor including a series of annularly spaced fan blades having a transverse extent substantially coextensive with the transverse extent of said endless track, a motion transmitting mechanism operatively connected between said leading roller and said fan rotor, said motion transmitting mechanism being constructed and arranged to rotate said fan rotor in response to the rotation of said leading roller at an increased speed proportional to the speed at which the leading roller is rotated due to the forwardly facing user walking or running on the upper surface of the upper flight of said endless track, and a guard fixed to said spaced frame members and extending transversely over said series of fan blades, said guard having a series of openings therein for the passage of air therethrough in a direction to impinge upon a forwardly facing user walking or running on the upper surface of the upper flight of the endless track, said series of fan blades being spaced upwardly from the horizontal support surface when said frame structure is in said operative position in an arrangement which provides an air inlet for said series of fan blades, said series of fan blades and said guard and the openings therein being constructed and arranged to enable the rotation of said series of fan blades with said fan rotor due to a forwardly facing user walking or running on the upper surface of the upper flight of said endless track to create a flow of air entering through the air inlet to pass upwardly through the openings in said guard to impinge on the forwardly facing user with a velocity which is determined by the rate at which the user is walking or running on the upper surface of the upper flight of the endless track, said fan rotor with said series of fan blades being devoid of any source of rotative power connected therewith and being rotated to create said flow of air solely by the manual effort of the forwardly facing user walking or running on the upper surface of the upper flight of said endless track, said fan rotor with said series of fan blades thereon being constructed and arranged to enable said flow of air to establish a retardant to the continued movement of the endless track when the user desires to slow the walking or running speed or disembark.

2. A motorless manually operated treadmill exerciser as defined in claim 1 wherein said frame structure includes a pair of transversely spaced support members operatively connected with said frame members so that when said frame members are disposed in said operative position said support members are upright and disposed above said flexible endless track in a position to be grasped by a user manually walking or running on the upper flight of the endless track.

3. A motorless manually operated treadmill exerciser as defined in claim 2 wherein said frame structure includes a base structure positioned to engage the solid horizontal surface at a position spaced substantially forwardly of the rearward end of said treadmill assembly when said parallel frame members are in said operative position, said support members being fixedly connected with said base structure and forming therewith a base and upright support construction, the forward end portions of said parallel frame members being pivotally interconnected with said base and upright support construction for movement about a transverse axis between said operative position and a storage position wherein said parallel frames members and said treadmill assembly are disposed in an upright position near said upright support members.

4. A motorless manually operated treadmill exerciser as defined in claim 3 wherein said base structure is formed by a forwardly opening U-shaped base member.

5. A motorless manually operated treadmill exerciser as defined in claim 4 wherein said pair of transversely spaced support members are interconnected by a U-shaped support member having upwardly and forwardly inclined leg portions fixed at intermediate portions thereof with the upper ends of said pair of support members and a bight portion disposed forwardly and above the upper ends of said pair of support members, said leg portions having end portions bent downwardly and forwardly with extremities fixed to said pair of support members below the upper ends thereof.

6. A motorless manually operated treadmill exerciser as defined in claim 3 wherein said frame structure has mounted thereon an upper body exercising assembly constructed and arranged to be grasped by the hands and moved by the arms of a forwardly facing user while walking or running on the upper surface of the upper flight of said endless track.

7. A motorless manually operated treadmill exerciser as defined in claim 6 wherein said upper body exercising assembly includes a pair of elongated arm members disposed in upright positions near said pair of support members, an adjustable friction applying pivotal retaining assembly between a lower end portion of each of said arm members and said frame structure constructed and arranged to mount said arm members on said frame structure for independent pivotal movement about a transverse axis parallel with the axis of said fan rotor, and hand grip elements on upper end portions of said arm members constructed and arranged to be gripped by the hands of a forwardly facing user walking or running on the upper flight of the endless track.

8. A motorless manually operated treadmill exerciser as defined in claim 6 wherein rearward end portions of said frame members and said treadmill assembly are supported on the solid horizontal surface in a selected one of a series of vertically adjusted operative positions spaced thereabove by an adjustable support assembly operatively connected with rearward end portions of said pair of frame members in depending relation.

9. A motorless manually operated treadmill exerciser as defined in claim 8 wherein said adjustable support assembly includes a U-shaped connecting member pivotally mounted having upwardly extending legs and a selector assembly pivotally mounting the upwardly extending legs of said connecting member with said frame members in a selected position of pivotal movement.

10. A motorless manually operated treadmill exerciser as defined in claim 1 wherein said motion transmitting mechanism comprises a pair of transversely spaced relatively large pulleys fixed with respect to said leading roller at opposite ends thereof, a pair of transversely spaced relatively small pulleys fixed with respect to said fan rotor at opposite ends of said series of fan blades and a belt trained about each associated set of relatively large and small pulleys.

11. A motorless manually operated treadmill exerciser as defined in claim 1 wherein said frame structure has mounted thereon an upper body exercising assembly constructed and arranged to be grasped by the hands and moved by the arms of a forwardly facing user while walking or running on the upper surface of the upper flight of said endless track.

12. A motorless manually operated treadmill exerciser as defined in claim 11 wherein said upper body exercising assembly includes a pair of elongated arm members disposed in upright positions near said pair of support members, an adjustable friction applying pivotal retaining assembly between a lower end portion of each of said arm members and said frame structure constructed and arranged to mount said arm members on said frame structure for independent pivotal movement about a transverse axis parallel with the axis of said fan rotor, and hand grip elements on upper end portions of said arm members constructed and arranged to be gripped by the hands of a forwardly facing user walking or running on the upper flight of the endless track.

13. A motorless manually operated treadmill exerciser as defined in claim 1 wherein rearward end portions of said frame members and said treadmill assembly are supported on the solid horizontal surface in a selected one of a series of vertically adjusted operative positions spaced thereabove by an adjustable support assembly operatively connected with rearward end portions of said pair of frame members in depending relation.

14. A motorless manually operated treadmill exerciser as defined in claim 13 wherein said adjustable support assembly includes a U-shaped connecting member pivotally mounted having upwardly extending legs and a selector assembly pivotally mounting the upwardly extending legs of said connecting member with said frame members in a selected position of pivotal movement.

* * * * *